US011661230B2

(12) United States Patent
Oliveira

(10) Patent No.: US 11,661,230 B2
(45) **Date of Patent: *May 30, 2023**

(54) STACKABLE CARTONS, SYSTEM, AND METHODS OF USING THE SAME

(71) Applicant: Graphic Packaging International, LLC, Atlanta, GA (US)

(72) Inventor: Steven M. Oliveira, Canton, GA (US)

(73) Assignee: Graphic Packaging International, LLC, Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/952,501

(22) Filed: Nov. 19, 2020

(65) Prior Publication Data

US 2021/0147108 A1 May 20, 2021

Related U.S. Application Data

(60) Provisional application No. 62/937,960, filed on Nov. 20, 2019.

(51) Int. Cl.
*B65D 5/00* (2006.01)
*B65D 5/66* (2006.01)
(Continued)

(52) U.S. Cl.
CPC ..... *B65D 5/003* (2013.01); *B65D 5/14* (2013.01); *B65D 5/4204* (2013.01);
(Continued)

(58) Field of Classification Search
CPC .... B65D 5/003; B65D 5/4204; B65D 5/6658; B65D 5/6664; B65D 5/6682;
(Continued)

(56) References Cited

U.S. PATENT DOCUMENTS 396,570 A 1/1889 Hotchkiss
637,838 A 11/1899 Vernon
(Continued)

FOREIGN PATENT DOCUMENTS

CA 1079240 6/1980
FR 3008386 4/2016
(Continued)

OTHER PUBLICATIONS

International Search Report and Written Opinion for PCT/US2020/061211 dated Mar. 2, 2021.
(Continued)

*Primary Examiner* — Rafael A Ortiz
*Assistant Examiner* — Sanjidul Islam
(74) *Attorney, Agent, or Firm* — Womble Bond Dickinson (US) LLP

(57) ABSTRACT

A carton for holding at least one article includes a plurality of panels extending at least partially around an interior of the carton, the plurality of panels includes a top panel, a bottom panel, a front panel, a back panel, and at least one side panel, and a plurality of end flaps foldably connected to a respective panel of the plurality of panels, the plurality of end flaps includes at least one top end flap foldably connected to the top panel. The at least one top end flap is upwardly folded relative to the top panel to at least partially maintain a closed configuration of the carton in which the top panel is recessed below a portion of each of the front panel, the back panel, and the at least one side panel to form a recessed top portion for receiving a portion of a vertically adjacent carton.

42 Claims, 8 Drawing Sheets

(51) Int. Cl.
*B65D 5/42* (2006.01)
*B65D 21/04* (2006.01)
*B65D 5/14* (2006.01)

(52) U.S. Cl.
CPC ..... *B65D 5/6655* (2013.01); *B65D 5/6664* (2013.01); *B65D 5/6682* (2013.01); *B65D 21/041* (2013.01)

(58) Field of Classification Search
CPC ..... B65D 21/0223; B65D 21/0041; B65D 5/0245; B65D 5/14; B65D 21/0209; B65D 21/04
USPC ..... 229/143, 152, 169, 175, 915; 206/509
See application file for complete search history.

(56) References Cited

U.S. PATENT DOCUMENTS 1,373,365 A 3/1921 Smouse
1,892,756 A 1/1933 Van Horne
2,330,521 A 9/1943 Scheide
2,341,762 A 2/1944 Conklin
2,355,729 A 8/1944 Inman
2,355,730 A 8/1944 Inman
2,645,337 A * 7/1953 Stenger ..... B65D 5/6661 206/777
2,926,782 A 3/1960 Noble
3,027,063 A 3/1962 Zastrow
3,124,295 A * 3/1964 Kauffeld ..... B65D 5/14 229/211
3,324,999 A 6/1967 Farquhar
3,355,089 A 11/1967 Champlin
3,447,735 A 6/1969 Whitney
D217,441 S 5/1970 Kanaga
3,840,172 A 10/1974 Zimmermann
3,886,901 A 6/1975 Zeitter
3,949,928 A 4/1976 Perkins
4,068,795 A 1/1978 Forster
D256,437 S 8/1980 Faller
4,277,015 A 7/1981 Crane
4,328,923 A 5/1982 Graser
4,340,169 A 7/1982 Webinger
4,449,633 A 5/1984 Johnson et al.
D283,491 S 4/1986 Edwards
4,809,908 A * 3/1989 Keefe ..... B65D 5/241 229/150
5,016,813 A 5/1991 Simons
5,094,359 A 3/1992 DeMars et al.
5,125,565 A 6/1992 Rogers
5,170,934 A 12/1992 Lemoine
5,292,058 A 3/1994 Zoss et al.
5,294,044 A 3/1994 Clark
5,307,986 A 5/1994 Schuster
5,388,758 A 2/1995 Scovell
5,411,204 A 5/1995 Demay
5,520,284 A 5/1996 Gray
5,522,538 A 6/1996 Gray
6,041,997 A 3/2000 Jensen
6,126,065 A 10/2000 Wee
6,298,992 B1 10/2001 Tsao
6,299,059 B1 10/2001 Bernstein
D458,127 S 6/2002 De Groote
D467,499 S 12/2002 Garza et al.
D473,787 S 4/2003 Jones, Jr. et al.
D484,043 S 12/2003 Hwang et al.
6,676,010 B1 1/2004 Roseth et al.
D501,318 S 2/2005 Louie
D519,366 S 4/2006 Epstein
7,021,525 B2 4/2006 Jouppi et al.
D519,830 S 5/2006 Yocum
D524,154 S 7/2006 Post
D561,023 S 2/2008 Jacxsens
7,552,820 B2 6/2009 Kohler
7,669,755 B2 3/2010 Smalley
7,699,214 B2 4/2010 Mestre et al.
D622,589 S 8/2010 Elias
D630,508 S 1/2011 Hubbard, Jr.
D631,741 S 2/2011 Hubbard, Jr.
D631,742 S 2/2011 Hubbard, Jr.
D631,743 S 2/2011 Hubbard, Jr.
7,938,257 B2 5/2011 Kohler
D666,830 S 9/2012 Glenn
D684,858 S 6/2013 Sill
8,740,050 B2 6/2014 Zinck et al.
8,770,466 B1 7/2014 Terlesky
D717,162 S 11/2014 Baker
9,169,037 B2 10/2015 Pinkstone
D753,994 S 4/2016 Pantelleria
9,309,023 B2 4/2016 Hubbard, Jr.
D755,624 S 5/2016 Ng
9,346,234 B2 5/2016 Hajek et al.
D760,497 S 7/2016 Martin
D762,468 S 8/2016 Pantelleria et al.
D769,114 S 10/2016 Montemayor
D770,274 S 11/2016 Safer
9,505,516 B2 11/2016 Hubbard, Jr.
D775,947 S 1/2017 Epstein
9,540,132 B1 1/2017 Lee
9,701,438 B2 7/2017 Fitzwater et al.
D796,949 S 9/2017 Hartley
D805,894 S 12/2017 Lee
D808,258 S 1/2018 Lee
D810,561 S 2/2018 Garnett
D811,875 S 3/2018 Haen et al.
D813,029 S 3/2018 Borkovetz et al.
10,017,290 B2 7/2018 Faulkner et al.
10,086,972 B2 10/2018 Hajek
10,232,973 B2 3/2019 Burke
10,239,651 B2 3/2019 Exner et al.
D848,834 S 5/2019 Exner
D848,835 S 5/2019 Exner
D858,273 S 9/2019 Exner
D860,781 S 9/2019 Exner
D861,482 S 10/2019 Lebeau
D864,751 S 10/2019 Exner
D864,753 S 10/2019 Exner
D876,951 S 3/2020 Sill
D901,295 S 11/2020 Sytsma
D902,031 S 11/2020 Sytsma
10,913,566 B2 * 2/2021 Exner ..... B65D 5/4604
2004/0031842 A1 2/2004 Westerman et al.
2004/0182916 A1 9/2004 Roseth
2005/0218202 A1 10/2005 Braoudakis
2005/0263573 A1 * 12/2005 Goglio ..... B65D 5/2057 229/109
2005/0279815 A1 12/2005 Fogle et al.
2006/0255105 A1 11/2006 Sweet
2007/0095881 A1 5/2007 Manaige
2008/0087679 A1 4/2008 Cook
2008/0876791 4/2008 Cook
2009/0039144 A1 2/2009 Hooi et al.
2011/0308991 A1 12/2011 Hubbard
2012/0111931 A1 5/2012 Kimhi
2014/0263600 A1 9/2014 Valencia
2017/0008661 A1 1/2017 Flatley
2019/0256241 A1 8/2019 Exner et al.

FOREIGN PATENT DOCUMENTS

JP 2004-123101 4/2004
JP 2009-073536 4/2009
KR 20-0171748 Y1 3/2000
KR 10-2009-0040617 A 4/2009
WO WO 89/10308 11/1989
WO WO 2017/048518 A1 3/2017

OTHER PUBLICATIONS

Colpac Vizione Cardboard Food Tray, [online] Published on Apr. 20, 2017. Retrieved Dec. 18, 2018 from URL: http://www.

(56) References Cited

OTHER PUBLICATIONS castawayfoodpackaging.co.nz/product/01viztfl-vizione-cardboard-food-tray/.

* cited by examiner

STACKABLE CARTONS, SYSTEM, AND METHODS OF USING THE SAME

CROSS-REFERENCE TO RELATED APPLICATION

This application claims the benefit of U.S. Provisional Patent Application No. 62/937,960, filed on Nov. 20, 2019.

INCORPORATION BY REFERENCE

The disclosures of each of U.S. patent application Ser. No. 16/281,434, filed on Feb. 21, 2019 (now published as U.S. Publication No. 2019/0256241) and U.S. Provisional Patent Application No. 62/937,960, filed on Nov. 20, 2019, are hereby incorporated by reference for all purposes as if presented herein in their entirety.

BACKGROUND OF THE DISCLOSURE

The present disclosure relates to stackable cartons, systems of stackable cartons, blanks for forming stackable cartons, and methods associated with cartons that are stackable.

SUMMARY OF THE DISCLOSURE

According to one aspect, the disclosure is generally directed to a carton for holding at least one article, the carton comprising a plurality of panels extending at least partially around an interior of the carton, the plurality of panels comprising a top panel, a bottom panel, a front panel, a back panel, and at least one side panel, and a plurality of end flaps foldably connected to a respective panel of the plurality of panels, the plurality of end flaps comprising at least one top end flap foldably connected to the top panel. The at least one top end flap is upwardly folded relative to the top panel to at least partially maintain a closed configuration of the carton in which the top panel is recessed below a portion of each of the front panel, the back panel, and the at least one side panel to form a recessed top portion for receiving a portion of a vertically adjacent carton.

According to another aspect, the disclosure is generally directed to a blank for forming a carton for holding at least one article, the blank comprising a plurality of panels comprising a top panel, a bottom panel, a front panel, a back panel, and at least one side panel, and a plurality of end flaps foldably connected to a respective panel of the plurality of panels, the plurality of end flaps comprising at least one top end flap foldably connected to the top panel. The at least one top end flap is for being upwardly folded to at least partially maintain a closed configuration of the carton formed from the blank in which the top panel is recessed below a portion of each of the front panel, the back panel, and the at least one side panel to form a recessed top portion for receiving a portion of a vertically adjacent carton when the carton is formed from the blank.

According to another aspect, the disclosure is generally directed to a method of forming a carton for holding at least one article, the method comprising obtaining a blank comprising a plurality of panels and a plurality of end flaps foldably connected to a respective panel of the plurality of panels, the plurality of panels comprising a top panel, a bottom panel, a front panel, a back panel, and at least one side panel, and the plurality of end flaps comprising at least one top end flap foldably connected to the top panel. The method further comprises folding the plurality of panels at least partially around the interior of the carton, and forming a closed configuration of the carton in which the top panel is recessed below a portion of each of the front panel, the back panel, and the at least one side panel to form a recessed top portion for receiving a portion of a vertically adjacent carton, the forming the closed configuration of the carton comprising upwardly folding the at least one top end flap to at least partially maintain the closed configuration of the carton.

According to another aspect, the disclosure is generally directed to a system of cartons for holding at least one article, the system comprising a first carton, the first carton comprising a plurality of panels extending at least partially around an interior of the first carton, the plurality of panels comprising a top panel, a bottom panel, a front panel, a back panel, and at least one side panel, and a plurality of end flaps foldably connected to a respective panel of the plurality of panels, the plurality of end flaps comprising at least one top end flap foldably connected to the top panel. The at least one top end flap is upwardly folded to at least partially maintain a closed configuration of the first carton in which the top panel is recessed below a portion of each of the front panel, the back panel, and the at least one side panel to form a recessed top portion. The system further comprises a second carton at least partially received in the recessed top positron of the first carton.

According to common practice, the various features of the drawings discussed below are not necessarily drawn to scale. Dimensions of various features and elements in the drawings may be expanded or reduced to more clearly illustrate the embodiments of the disclosure.

BRIEF DESCRIPTION OF THE DRAWINGS

Corresponding parts are designated by corresponding reference numbers throughout the drawings.

DETAILED DESCRIPTION OF THE EXEMPLARY EMBODIMENTS

The containers of the present disclosure can be useful in supporting/containing a food product or other article such as any suitable type of food product. For example, the food product could include frozen food products or non-frozen food products. Some suitable food products could include such as French fries, chicken nuggets, chicken legs, chicken wings, drumsticks, chicken strips, fish sticks, mozzarella sticks, pizza, French bread pizza, sandwiches, calzones, turnovers, burritos, vegetables, popcorn, or any other suitable food product, any of which can be provided as a frozen or unfrozen food product. It will be understood that food products other than the food products listed herein may be contained in the disclosed packages and/or containers. Further, food products disclosed herein can be generally rectangular, triangular, round, square, irregular, or any other shape.

In this specification, the terms "lower," "bottom," "upper," and "top" indicate orientations determined in relation to fully erected and upright containers. As described herein, containers can be formed from blanks by overlapping multiple portions, components, and/or elements thereof. Such portions, components, and/or elements may be designated herein in terms relative to one another, e.g., "first", "second", "third", etc., in sequential or non-sequential reference, without departing from the disclosure.

Figure 1:
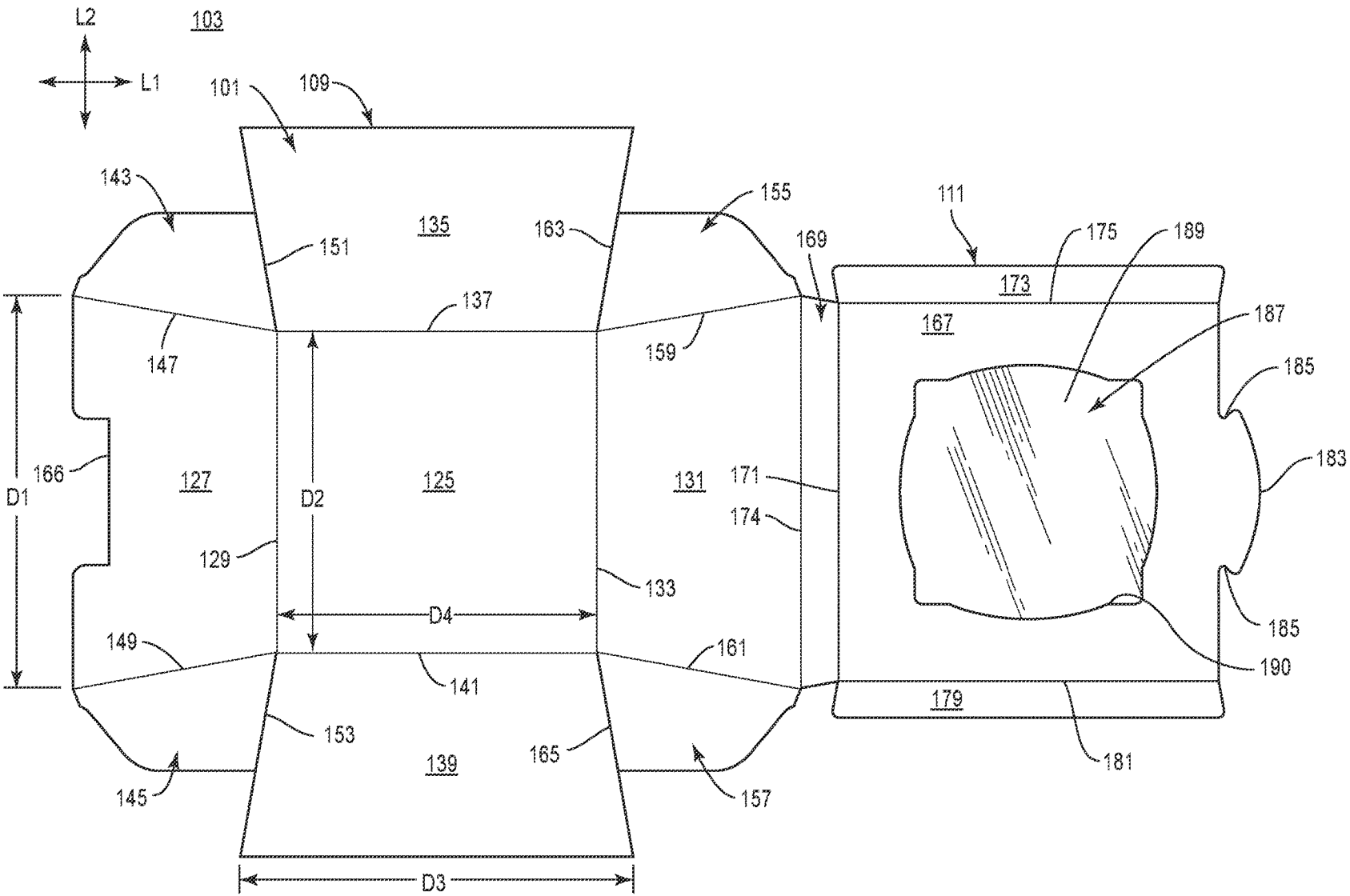
FIG. 1 is a plan view of an exterior surface of a blank for forming a carton according to a first exemplary embodiment of the disclosure.

FIG. 1 is a plan view of an exterior surface 101 of a carton blank 103 that can be obtained for forming a carton 105 (FIG. 2) according to a first exemplary embodiment of the disclosure. The carton 105 is provided to extend at least partially around an interior 107 of the carton 105 for holding at least one article contained therein, for example, a food or beverage product or related packaging, and, as shown in FIG. 3, is provided with a recessed top portion 108 that receives a portion of another vertically stacked carton to form a system of multiple stacked cartons.

The blank 103, as shown, has a longitudinal axis L1 and a lateral axis L2. The illustrated blank 103 has a tray portion 109 for forming a tray 113 of the carton 105, and the tray portion 109 includes a bottom panel 125, a front panel 127 foldably connected to the bottom panel 125 at a lateral fold line 129, a back panel 131 foldably connected to the bottom panel 125 at a lateral fold line 133, a first side panel 135 foldably connected to the bottom panel 125 at a longitudinal fold line 137, and a second side panel 139 foldably connected to the bottom panel 25 at a longitudinal fold line 141.

The blank 103 can also include a plurality of end flaps foldably connected to respective panels of the plurality of panels, and can include a first front end flap 143 and a second front end flap 145 that are foldably connected to the front panel 127 at respective oblique fold lines 147, 149, and that are separated from the respective first side panel 135 and second side panel 139 at respective oblique cuts 151, 153.

Similarly, a first back end flap 155 and a second back end flap 157 can be foldably connected to the back panel 131 at respective oblique fold lines 159, 161, and can be separated from the respective first side panel 135 and second side panel 139 at respective oblique cuts 163, 165. A notch or recess 166 can be defined along a free edge of the front panel 127 for receiving a portion of the lid portion 111/lid 115.

As described further herein, the carton 105 assembled from the blank 103 has a tapered configuration, with a free edge or top edge of each of the front panel 127 and the back panel 131 defining a first lateral length D1 that is greater than a second lateral length D2 that is defined by each of the fold lines 129, 133. Similarly, a free edge or top edge of each of the first side panel 135 and the second side panel 139 define a first longitudinal length 103 that is greater than a second longitudinal length D4 defined by each of the fold lines 137, 141.

Still referring to FIG. 1, the blank 103 also includes a lid portion 111 for forming a lid 115 of the carton 105. The lid portion 111 of the blank 103 includes a top panel 167, a hinge panel 169 foldably connected to the top panel 167 at a longitudinal fold line 171, a first top end flap 173 foldably connected to the top panel 167 at a longitudinal fold line 175, and a second top end flap 179 foldably connected to the top panel 167 at a longitudinal fold line 181. A handle/locking tab 183 protrudes from the top panel 167, and is at least partially defined by a pair of laterally-spaced notches 185.

As also shown, the hinge panel 169 is foldably connected to the back panel 131 at a lateral fold line 174. In this regard, the hinge panel 169 is defined between the fold lines 171, 174 so as to foldably connect the lid portion 111/lid 115 to the tray portion 109/tray 113 at the fold line 174. In one embodiment, the blank 103 can be devoid of a hinge panel 169 and the top panel 167 can be foldably connected to the back panel 131 at the fold line 174.

As shown, a window 187 is defined in the top panel 167, and as described further herein, can allow a user or customer to view the interior 107 of the carton 105 through the top panel 167, e.g., to inspect or identify a food product therein. In this regard, a liner 189 can be applied, e.g., adhered, laminated, heat sealed, etc., to at least a portion of the top panel 167 so as to overlie an opening 190 in the top panel 167 to form the window 187, for example, to maintain a desired condition (e.g., temperature, humidity, etc.) of food products in the interior 107 of the carton 105 and/or to inhibit the passage of debris or pests through the window 187.

The liner 189 can be formed of a polymeric material such as PET, cellophane, plastic, etc. The liner 189 may be at least partially transparent to enhance visibility through the window 187 to the interior 107 of the carton 105. The liner 189 can be selected with other properties, for example, moisture resistance or an anti-fog treatment to minimize the development of steam or condensation across the window 187. In one embodiment, the liner 189 can be applied to the interior surface of the top panel 167. The carton 105 can be devoid of a window 187, opening 190, and/or liner 189 without departing from the disclosure.

It will be understood that one or more of the panels, end flaps, window, and associated features can have a different size, shape, and/or configuration without departing from the disclosure.

Figure 2:
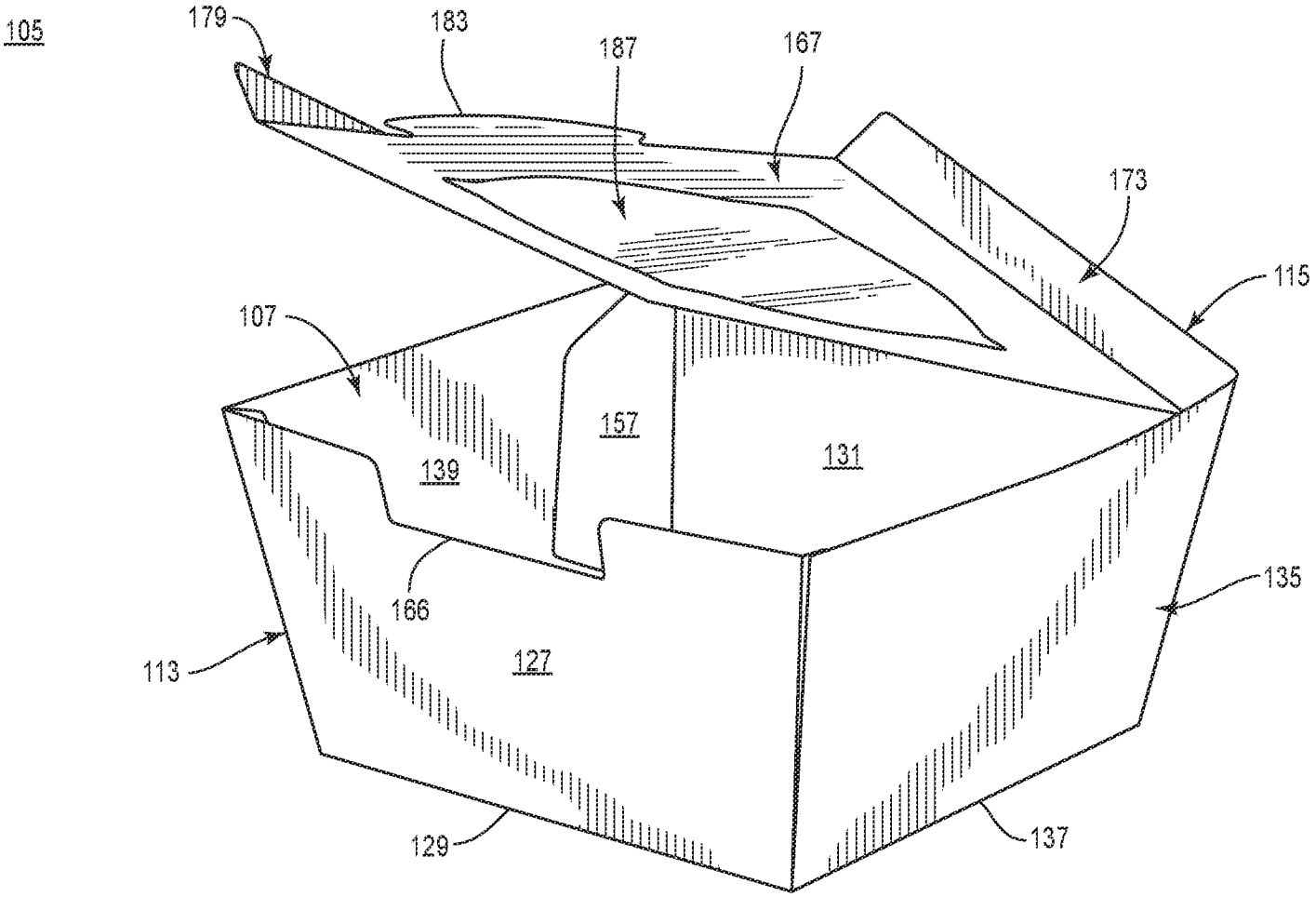
FIG. 2 is a perspective view of a carton formed from the blank of FIG. 1 and in an open configuration according to the first exemplary embodiment of the disclosure.
Figure 3:
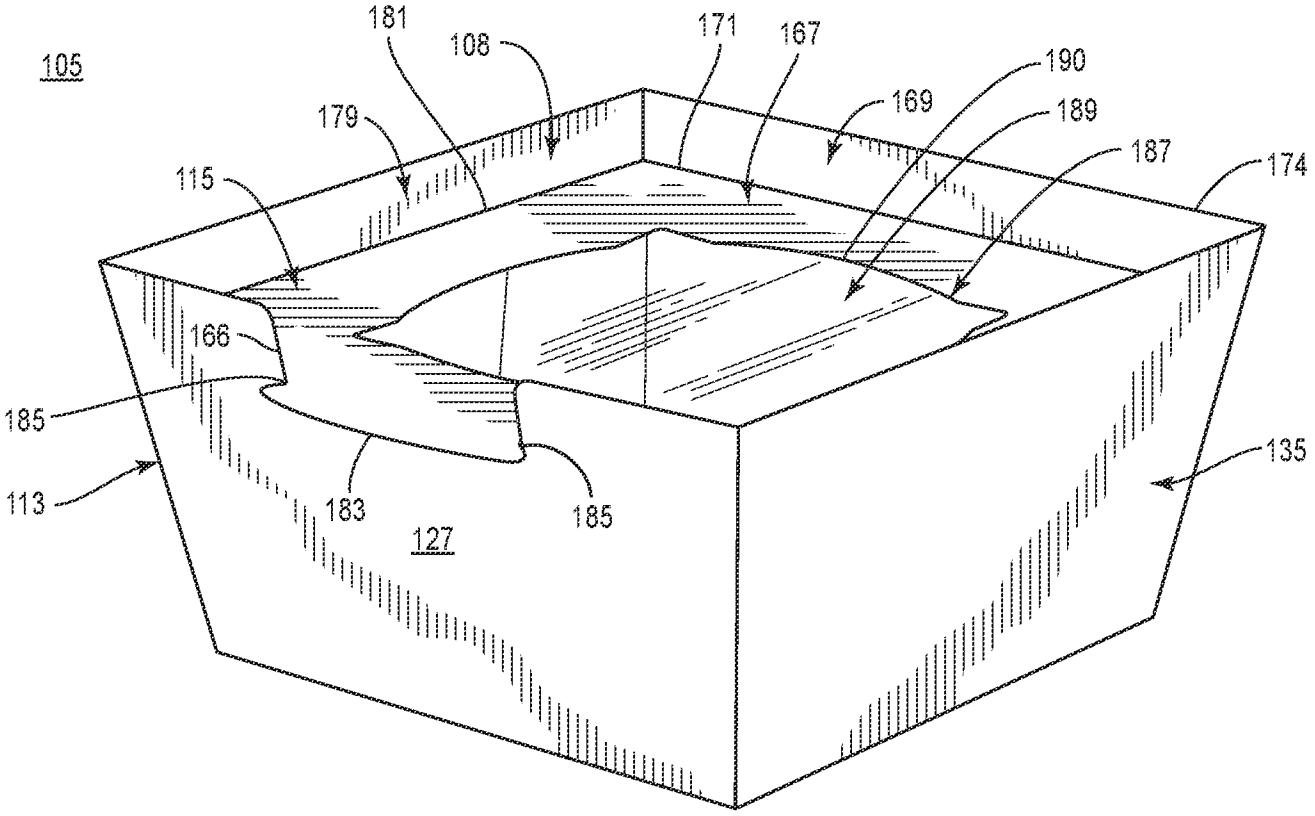
FIG. 3 is a perspective view of the carton of FIG. 2 in a closed configuration.

As shown in FIG. 2, the blank 103 can be formed into the carton 105, in one embodiment, by forming the tray 113 by folding/raising the front panel 127, the back panel 131, the first side panel 135, and the second side panel 139 at the respective fold lines 129, 133, 137, 141 to raise upwardly from the bottom panel 125 and to at least partially extend around the interior 107 of the carton 105. In addition, the end flaps 143, 145, 155, 517 can be folded at the respective fold lines 147, 149 and fold lines 159, 161 such that the end flaps 143, 155 are positioned in at least partial face-to-face contact with the first side panel 135 and such that the end flaps 145, 157 are positioned in at least partial face-to-face contact with the second side panel 139. Such an arrangement of the tray 113 of the carton 105 can be maintained, for example, with an adhesive such as glue.

The carton 105 is provided with an openable configuration in which the lid 115 is hingeably attached to the tray 113 and positionable between a closed position wherein the lid 115 at least partially closes the interior 107 of the carton 105 and an open position wherein the lid 115 is raised to provide access to the interior 107.

In this regard, the positioning of the front panel 127, the back panel 131, the first side panel 135, and the second side panel 139 is such to be tapered or angled outwardly relative to the bottom panel 125 to position the respective top edges of the front panel 127, the back panel 131/fold line 174, the first side panel 135, and the second side panel 139 in a manner to allow the top panel 167 to fit within the top opening defined by the respective top edges. Accordingly, such top opening is larger than the bottom panel 125.

The angled position of the front panel 127, the back panel 131, the first side panel 135, and the second side panel 139 and the wider opening formed by the top edges of the front panel 127, the back panel 131/fold line 174, the first side panel 135, and the second side panel 139 allows the top panel 167 to be received through the wide top opening and positioned below the respective top edges of the front panel 127, the back panel 131/fold line 174, the first side panel 135, and the second side panel 139 to close the carton 105 and to form a recessed top portion 108 of the carton 105.

In addition, the oblique configuration of the fold lines 147, 149, 159, 161 also facilitates the positioning of the front panel 127, the back panel 131, the first side panel 135, and the second side panel 139 at respective oblique angles relative to the bottom panel 125 such that the carton 105 has a tapered configuration that facilitates nesting and/or stacking, as described further herein. The front panel 127, the back panel 131, the first side panel 135, and the second side panel 139 could be otherwise positioned (e.g., tapered or angled more or less than shown) without departing from the scope of the disclosure.

Referring additionally to FIG. 3, in order to transition the carton 105 from the open configuration illustrated in FIG. 2 to the closed configuration illustrated in FIG. 3, the top panel 167 and/or hinge panel 169 can be folded downwardly at the respective fold lines 171, 174 toward the interior 107 of the carton 105 such that the handle tab 183 enters the recess 166 in the front panel 127 and such that the end flaps 173, 179 engage the top edges of the side panels 135, 139 and at least partially fold upwardly at the respective fold lines 175, 181. In one embodiment, the hinge panel 169 can be positioned in at least partial face-to-face contact with the back panel 131.

The top panel 167 can be lowered at least partially below the top edges of the side panels 135, 139 to a generally planar arrangement with and spaced above the bottom panel 125 so as to form a top recessed portion 108 between the top panel 167 and the upper edges of the panels 127, 131, 135, 139.

In such a closed configuration of the carton 105, the upwardly folded end flaps 173, 179 can be positioned in at least partial face-to-face contact with upper portions of the side panels 135, 139, and the handle/locking tab 183 can be positioned extending at least partially through the recess 166 in the front panel 127, with the notches 185 of the handle tab 183 generally aligned with lateral edges of the front panel 127 adjacent the recess 166, for example, to inhibit inadvertent opening or shifting of the lid 115. The presence of the handle tab 183 through the notch 166 as well as the position of the upwardly folded end flaps 173, 179 of the lid 115 engaging/contacting the interior surfaces of the side panels 135, 139 of the tray 113 can minimize, inhibit, and/or prevent the top panel 167 from being lowered too far into the interior of the tray 113 (e.g., past a parallel configuration with the bottom panel 125) when the lid 115 is closed.

The engagement/contact of the upwardly folded end flaps 173, 179 with the respective side panels 135, 139 can at least partially maintain the closed configuration of the carton 105, e.g., via frictional and/or interfering engagement with the respective side panels 135, 139. Furthermore, the position of the handle tab 183 extending at least partially through the recess 166 can at least partially maintain the closed configuration of the carton 105, e.g., via frictional and/or interfering engagement of the notches 185 with edges of the front panel 127.

It will be understood that the carton 105 can be transitioned from the closed configuration to the open configuration, for example, by grasping or lifting the handle tab 183 to raise the top panel 167 and/or the hinge panel 169 upwardly at the respective fold lines 171, 174 such that the interior 107 of the carton 105 is accessible. In one embodiment, the presence of the hinge panel 169 can allow the lid 115 to be further articulable, for example, by allowing the hinge panel 169 to tilt away from the back panel 131 to provide freedom of movement of the lid 115 in the longitudinal direction L1 as the lid 115 is raised and lowered.

Figure 4:
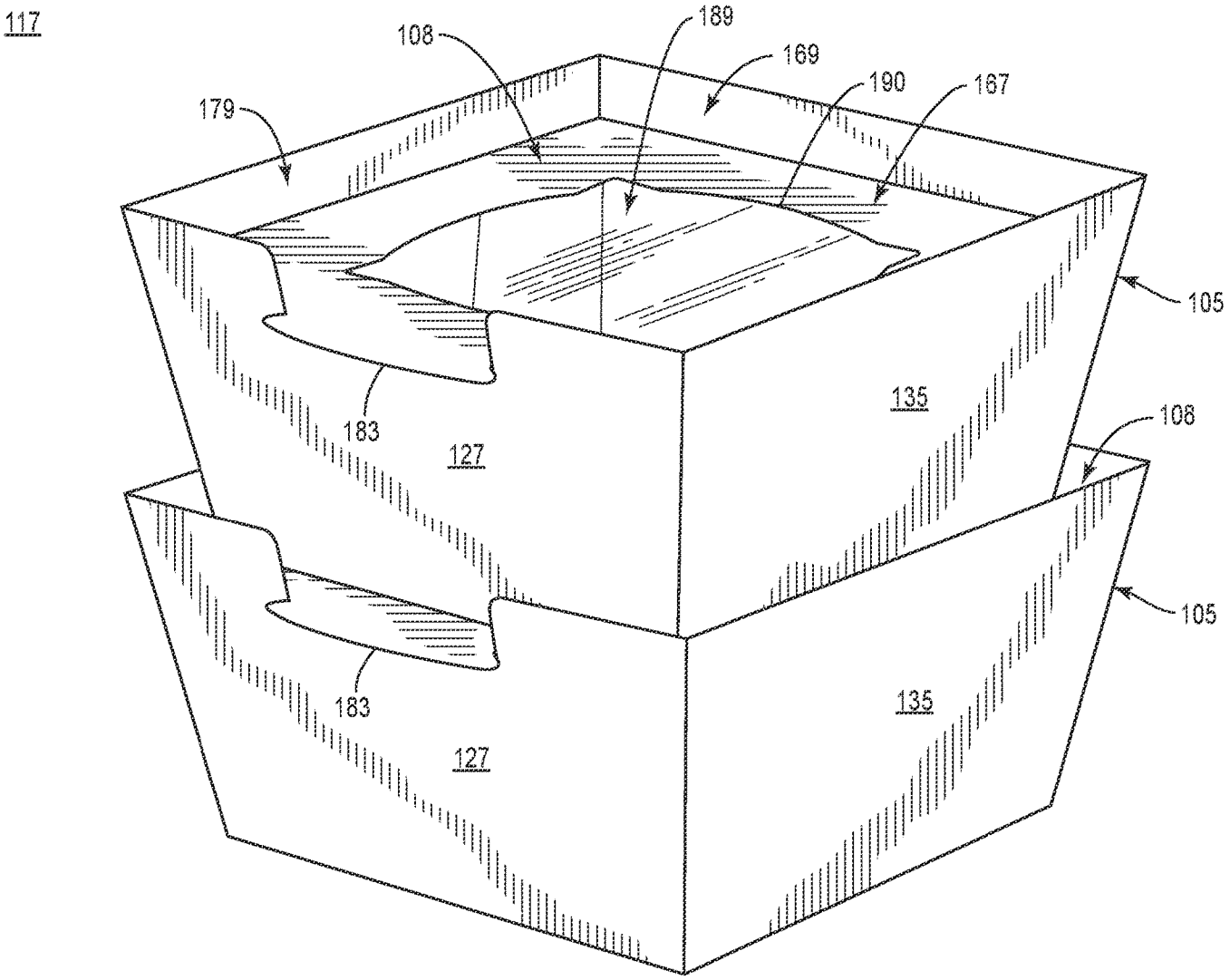
FIG. 4 is a perspective view of a system including a pair of the cartons of FIG. 3 in a stacked configuration according to the first exemplary embodiment of the disclosure.

Referring additionally to FIG. 4, a pair stacked cartons 105 is illustrated, with each carton 105 positioned to receive and support a portion of a vertically-adjacent carton 105 in a respective top recessed portion 108. In one embodiment, the bottom carton 105 can be a first carton, and the vertically-adjacent carton 105 can be considered a second carton. In addition to the support provided by the top panel 167 of the lower carton 105, the upper portions of the panels 127, 131, 135, 139, 169 and end flaps 173, 179 that extend above the recessed top panel 167 of the lower carton 105 provide front-to-back and side-to-side stability, e.g., by engaging lower portions, for example, bottom corners and edges, of the upper carton 105 to inhibit slidable movement thereof.

In this regard, a system 117 of stacked cartons 105 is provided wherein the cartons 105 are interlocked or stabilized by the engagement of the bottom portion of a respective carton 105 with the respective recessed top portion 108 of a respective carton 105 therebelow. It will be understood that in an open configuration of the carton 105, e.g., with the lid 115 raised relative to the remainder of the carton 105, a carton 105 can be nested within the interior 107 of a carton 105 therebelow, for example, to reduce space and/or to facilitate loading of the cartons 105. While a system 117 of two stacked cartons 105 is illustrated, more than two cartons 105 can be stacked in this manner without departing from the disclosure.

Figure 5:
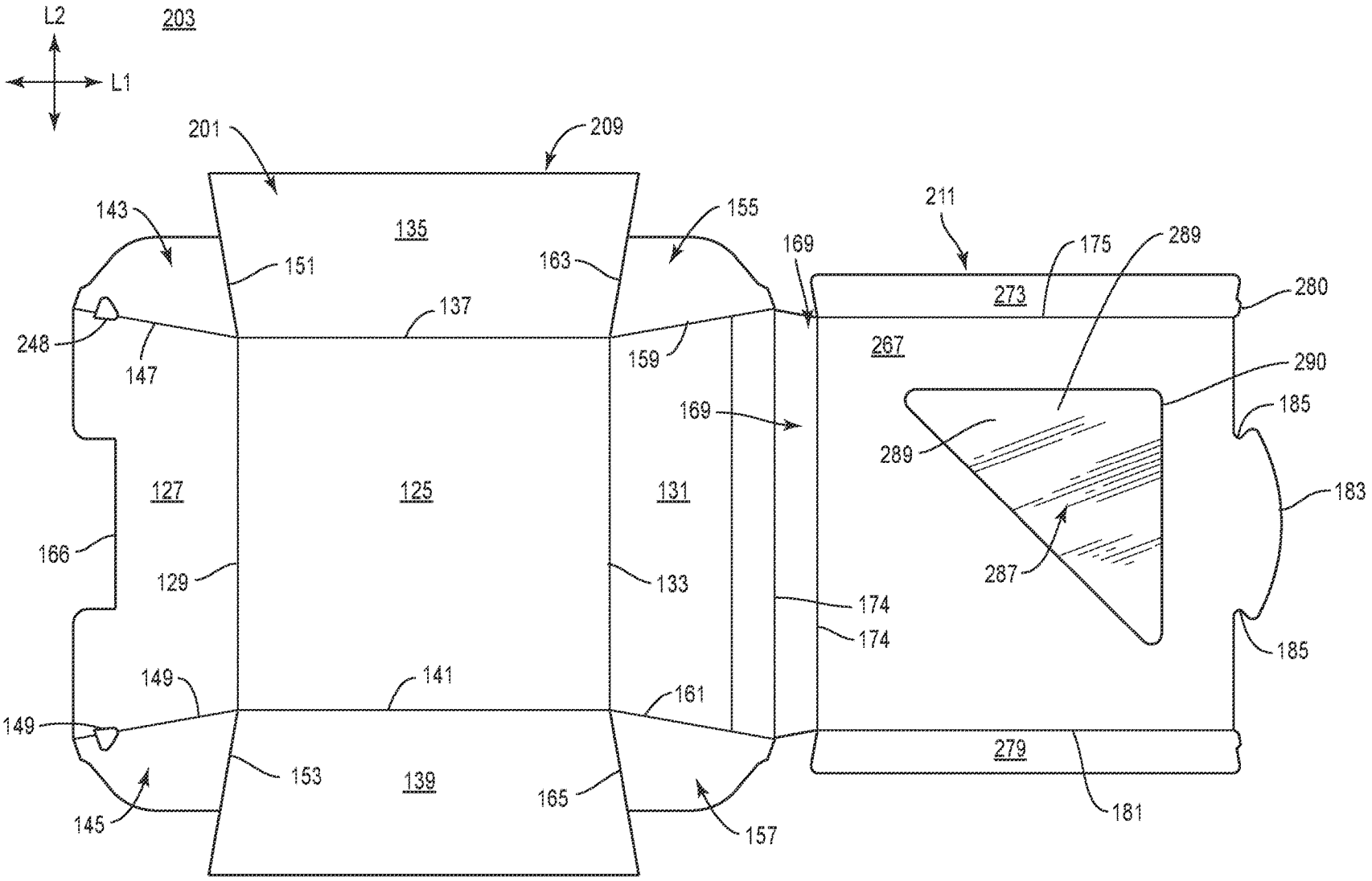
FIG. 5 is a plan view of an exterior surface of a blank for forming a carton according to a second exemplary embodiment of the disclosure.

Turning to FIG. 5, a plan view of an exterior surface 201 of a blank 203 for forming a carton 205 according to a second exemplary embodiment of the disclosure is illustrated. The blank 203/carton 205 can have one or more features that are substantially similar to those of the blank 103/carton 105 described above, and like or similar reference numerals are used to designate like or similar features.

As shown, the blank 203 has the longitudinal axis L1, the lateral axis L2, and includes a tray portion 209 for forming a tray 213 of the carton 205, and includes the bottom panel 135, the front panel 127, the back panel 131, the first side panel 135, the second side panel 139, and the end flaps 143, 145, 159, and 157. As also shown, the fold lines 147, 149 that foldably connect the respective end flaps 143, 145 to the front panel 127 are interrupted by respective locking openings 248, e.g., female locking features, for receiving respective male locking features of the lid portion 211 of the blank 203/lid 215 of the carton 205. In the illustrated embodiment, each locking opening 248 can extend at least partially into the front panel 127.

Still referring to FIG. 5, the lid portion 211/lid 215 can include the hinge panel 169 foldably connected to the back panel 131 at the lateral fold line 174, and a top panel 267 foldably connected to the hinge panel 169 at the lateral fold line 171.

The top panel 267 includes a window 287, and a liner 289 can be applied, e.g., adhered, laminated, heat sealed, etc., to at least a portion of the top panel 267 so as to overlie an opening 290 defined in the top panel 267 to form the window 287. The opening 290, as shown, can have a three-sided e.g., triangular profile, though the opening 290 can have a different configuration without departing from the disclosure. The liner 289 can have a configuration similar to the liner 189 described above and can be sized and/or shaped to correspond to the opening 290, though the liner 289 can have a different configuration without departing from the disclosure. The carton 205 can be devoid of a window 287, opening 290, and/or liner 289 without departing from the disclosure.

It will be understood that one or more of the panels, end flaps, window, and associated features can have a different size, shape, and/or configuration without departing from the disclosure.

As shown, a first top end flap 273 is foldably connected to the top panel 267 at the longitudinal fold line 175, and a second top end flap 279 is foldably connected to the top panel 267 at the longitudinal fold line 181. A lateral free edge of the top end flaps 273, 279 can define a respective locking tab 280 extending therefrom, e.g., a protruding or notched feature having one or more straight, curved, and/or angled portions. As described further herein, the locking tabs 280 can be male locking features for at least partially being received in the respective locking openings 248.

Figure 6:
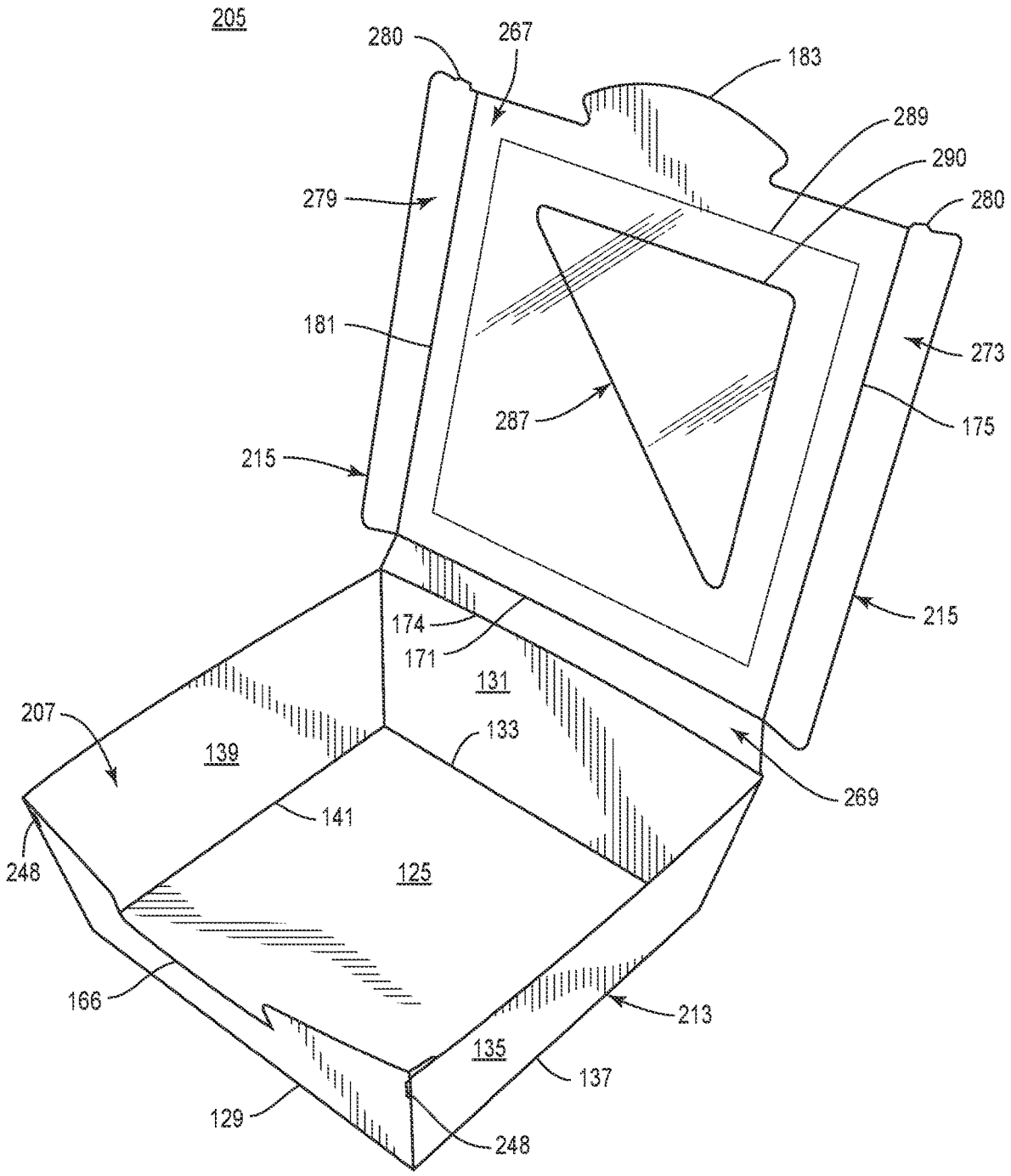
FIG. 6 is a perspective view of a carton formed from the blank of FIG. 5 and in an open configuration according to the second exemplary embodiment of the disclosure.

Referring additionally to FIG. 6, the carton 205 can be formed in a substantially similar manner as described above with regard to the carton 105, and is illustrated in an open configuration.

Figure 7:
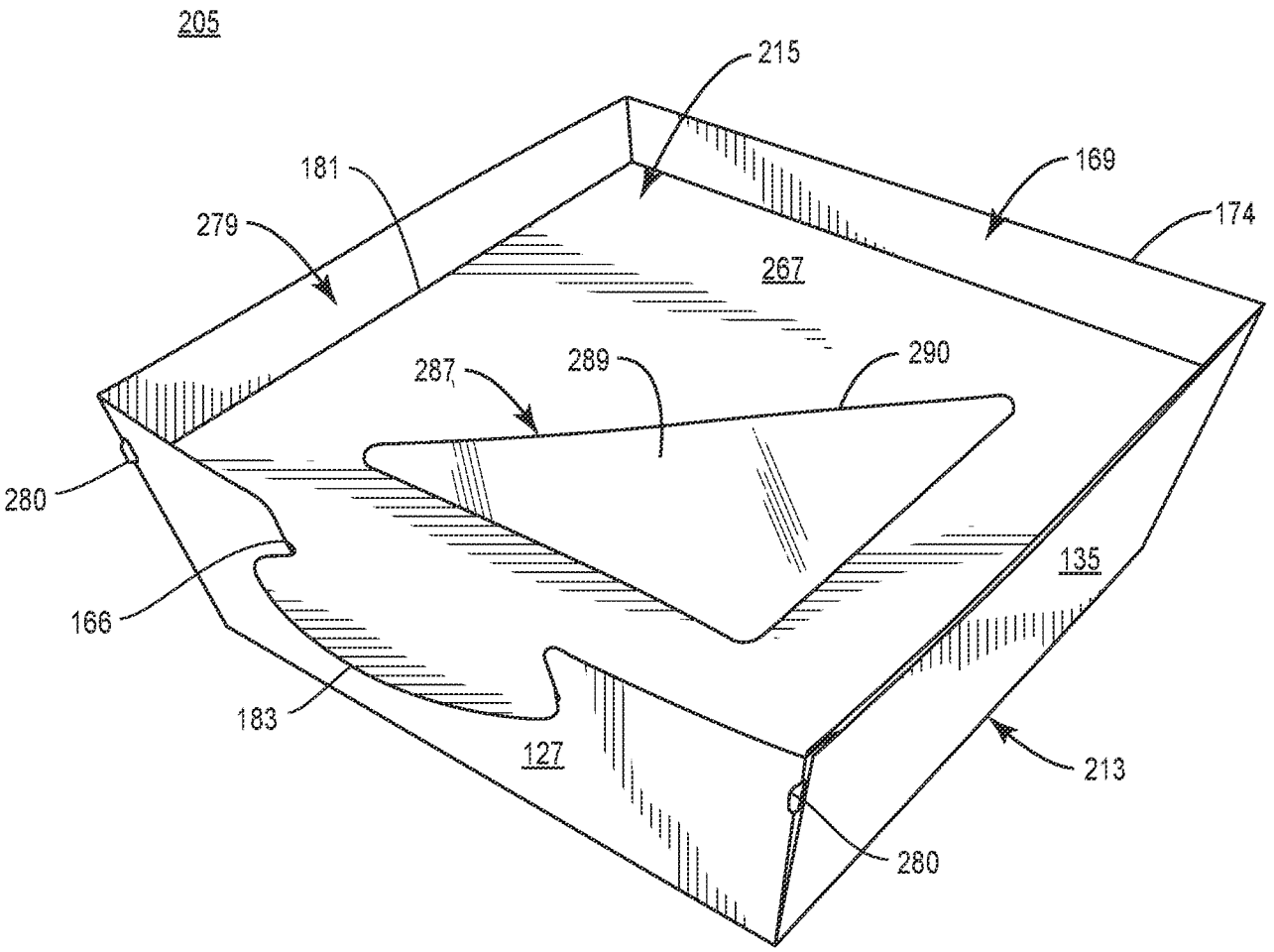
FIG. 7 is a perspective view of the carton of FIG. 6 in a closed configuration.

Turning to FIG. 7, in order to transition the carton 205 from the open configuration to a closed configuration, similar to the carton 105 described above, the top panel 267 and/or hinge panel 169 can be folded downwardly at the respective fold lines 171, 174 toward the interior 207 of the carton 205 such that the handle tab 183 enters the recess 166 in the front panel 127 and such that the end flaps 273, 279 engage the top edges of the side panels 135, 139 and at least partially fold upwardly at the respective fold lines 175, 181. The top panel 267 can be lowered at least partially below the top edges of the side panels 135, 139 to a generally planar arrangement with and spaced above the bottom panel 125 so as to form a top recessed portion 208 between the top panel 267 and the upper edges of the panels 127, 131, 135, 139. It will be understood that articulation of the top panel 267 can be provided by the hinge panel 169, e.g., such that the hinge panel 169 can be movable relative to one or both of the top panel 267 and the back panel 131.

As the lid 215 is closed over the tray 213 as described above, the locking tabs 280 protruding from the top end flaps 273, 279 are positioned to at least partially extend through the respective locking openings 248 to provide a lock/secure closure of the carton 205, e.g., to maintain the carton 205 in the closed configuration, to minimize, inhibit, and/or prevent inadvertent opening, etc. In this regard, in order to open the carton 205, the locking tabs 280 can be disengaged from the respective locking openings 248 before reversing the closure steps outlined above and as described above with regard to the carton 105.

Figure 8:
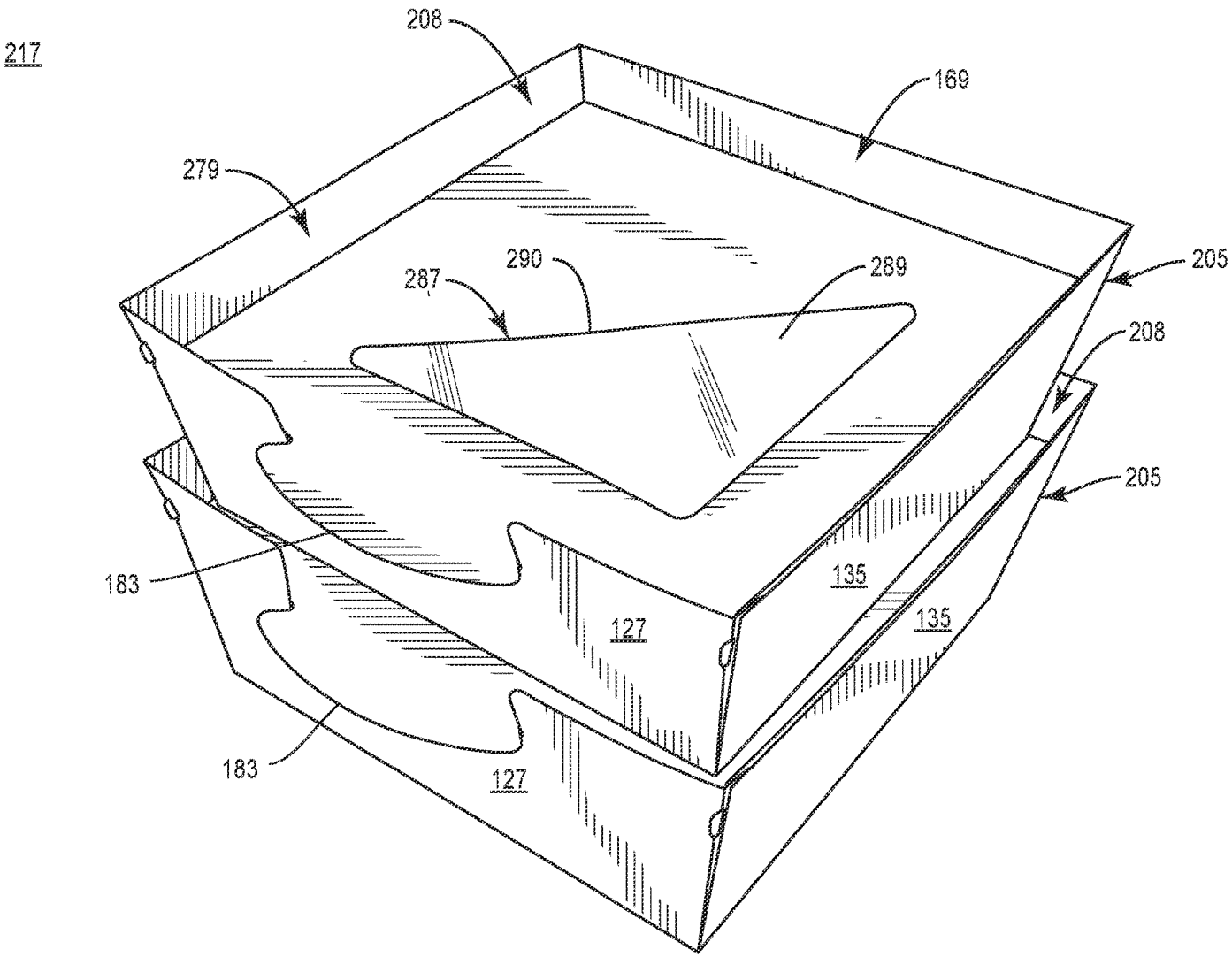
FIG. 8 is a perspective view of a system including a pair of the cartons of FIG. 7 in a stacked configuration according to the second exemplary embodiment of the disclosure.

Referring additionally to FIG. 8, a pair stacked cartons 205 is illustrated, with each carton 205 positioned to receive and support a portion of a vertically-adjacent carton 205 in a respective top recessed portion 208. In one embodiment, the bottom carton 205 can be a first carton, and the vertically-adjacent carton 205 can be considered a second carton. In addition to the support provided by the top panel 267 of the lower carton 205, the upper portions of the panels 127, 131, 135, 139, 169 and end flaps 273, 279 that extend above the recessed top panel 167 of the lower carton 205 provide front-to-back and side-to-side stability, e.g., by engaging lower portions, for example, bottom corners and edges, of the upper carton 205 to inhibit slidable movement thereof.

In this regard, a system 217 of stacked cartons 205 is provided wherein the cartons 205 are interlocked or stabilized by the engagement of the bottom portion of a respective carton 205 with the respective recessed top portion 208 of a respective carton 205 therebelow. It will be understood that in an open configuration of the carton 205, e.g., with the lid 215 raised relative to the remainder of the carton 205, one or more cartons 205 can be nested within the interior 207 of a carton 205 therebelow. While a system 217 of two stacked cartons 205 is illustrated, more than two cartons 205 can be stacked in this manner without departing from the disclosure.

In the foregoing embodiments, systems of cartons are provided with two or more generally similar cartons provided in a stacked configuration. However, it will be understood that a system of cartons can include two or more stacked cartons in which at least one of the cartons has a different configuration.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding there along. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding at least one article, the carton comprising:

a plurality of panels extending at least partially around an interior of the carton, the plurality of panels comprising a top panel, a bottom panel, a front panel foldably connected to the bottom panel, a back panel foldably connected to the bottom panel, and at least one side panel foldably connected to the bottom panel; and a plurality of end flaps foldably connected to a respective panel of the plurality of panels, the plurality of end flaps comprising at least one top end flap foldably connected to the top panel, the bottom panel, the front panel, the back panel, and the at least one side panel at least partially forming a tray of the carton, and the top panel at least partially forming a lid of the carton, the lid hingeably connected to the tray such that the lid is positionable between a closed position to form a closed configuration of the carton and an open position in which the lid is raised above the tray to provide access to the interior of the carton, the at least one top end flap upwardly folded relative to the top panel to contact a portion of the at least one side panel to at least partially maintain the closed configuration of the carton in which the top panel is recessed below a portion of each of the front panel, the back panel, and the at least one side panel to form a recessed top portion for receiving a portion of a vertically adjacent carton, the at least one top end flap for being raised away from the portion of the at least one side panel when the lid is in the open position.

2. The carton of claim 1, wherein a top opening defined by the recessed top portion is larger than the bottom panel.

3. The carton of claim 2, wherein the at least one side panel is a first side panel, the at least one top end flap is a first top end flap in contact with a portion of the first side panel, the plurality of panels further comprises a second side panel foldably connected to the bottom panel, and the plurality of end flaps further comprises a second top end flap foldably connected to the top panel and upwardly folded to contact a portion of the second side panel.

4. The carton of claim 3, wherein the plurality of panels further comprises a hinge panel foldably connected to each of the top panel and the back panel.

5. The carton of claim 4, wherein the hinge panel is in at least partial face-to-face contact with the back panel.

6. The carton of claim 2, wherein the top panel comprises a window for viewing the interior of the carton.

7. The carton of claim 6, wherein the window comprises an opening in the top panel and a film overlying the opening.

8. The carton of claim 7, wherein the film is formed of a polymeric material and is at least partially transparent.

9. The carton of claim 2, wherein at least one locking opening at least partially extends into the front panel, and the at least one top end flap comprises a locking tab at least partially received through the at least one locking opening to at least partially maintain the closed configuration of the carton.

10. The carton of claim 9, wherein the plurality of end flaps comprises at least one front end flap foldably connected to the front panel at a fold line and positioned in at least partial face-to-face contact with the at least one side panel, the at least one locking opening interrupts the fold line.

11. The carton of claim 9, wherein a recess is formed in a portion of the front panel, and the top panel comprises a handle tab that extends at least partially through the recess to at least partially maintain the closed configuration of the carton.

12. A blank for forming a carton for holding at least one article, the blank comprising:

a plurality of panels comprising a top panel, a bottom panel, a front panel foldably connected to the bottom panel, a back panel foldably connected to the bottom panel, and at least one side panel foldably connected to the bottom panel; and a plurality of end flaps foldably connected to a respective panel of the plurality of panels, the plurality of end flaps comprising at least one top end flap foldably connected to the top panel, the bottom panel, the front panel, the back panel, and the at least one side panel for at least partially forming a tray of the carton formed from the blank, and the top panel at least partially forming a lid of the carton formed from the blank, the lid of the carton formed from the blank for being hingeably connected to the tray of the carton formed from the blank such that the lid is positionable between a closed position to form a closed configuration of the carton formed from the blank and an open position in which the lid is raised above the tray to provide access to the interior of the carton formed from the blank, the at least one top end flap for being upwardly folded to contact the at least one side panel to at least partially maintain the closed configuration of the carton formed from the blank in which the top panel is recessed below a portion of each of the front panel, the back panel, and the at least one side panel to form a recessed top portion for receiving a portion of a vertically adjacent carton when the carton is formed from the blank, the at least one top end flap for being raised away from the portion of the at least one side panel when the lid is in the open position when the carton is formed from the blank.

13. The blank of claim 12, wherein the at least one side panel is a first side panel, the at least one top end flap is a first top end flap for being positioned in contact with a portion of the first side panel when the carton is formed from the blank, the plurality of panels further comprises a second side panel foldably connected to the bottom panel, and the plurality of end flaps further comprises a second top end flap foldably connected to the top panel and for being upwardly folded to contact a portion of the second side panel when the carton is formed from the blank.

14. The blank of claim 13, wherein the plurality of panels further comprises a hinge panel foldably connected to each of the top panel and the back panel.

15. The blank of claim 12, wherein the top panel comprises a window for viewing the interior of the carton formed from the blank.

16. The blank of claim 15, wherein the window comprises an opening in the top panel and a film overlying the opening.

17. The blank of claim 16, wherein the film is formed of a polymeric material and is at least partially transparent.

18. The blank of claim 12, the at least one top end flap comprises a locking tab for at least partially being inserted through a locking opening that extends into the front panel to at least partially maintain the closed configuration of the carton formed from the blank.

19. The blank of claim 18, wherein the plurality of end flaps comprises at least one front end flap foldably connected to the front panel at a fold line, the at least one locking opening interrupts the fold line.

20. The blank of claim 18, wherein a recess is formed in a portion of the front panel, and the top panel comprises a handle tab for extending at least partially through the recess to at least partially maintain the closed configuration of the carton formed from the blank.

21. A method of forming a carton for holding at least one article, the method comprising:

obtaining a blank comprising a plurality of panels and a plurality of end flaps foldably connected to a respective panel of the plurality of panels, the plurality of panels comprising a top panel, a bottom panel, a front panel foldably connected to the bottom panel, a back panel foldably connected to the bottom panel, and at least one side panel foldably connected to the bottom panel, and the plurality of end flaps comprising at least one top end flap foldably connected to the top panel, folding the plurality of panels at least partially around the interior of the carton;

folding the bottom panel, the front panel, the back panel, and the at least one side panel to at least partially form a tray of the carton;

positioning the top panel to at least partially form a lid of the carton, the lid hingeably connected to the tray such that the lid is positionable between a closed position to form a closed configuration of the carton and an open position in which the lid is raised above the tray to provide access to the interior of the carton; and forming the closed configuration of the carton in which the top panel is recessed below a portion of each of the front panel, the back panel, and the at least one side panel to form a recessed top portion for receiving a portion of a vertically adjacent carton, the forming the closed configuration of the carton comprising upwardly folding the at least one top end flap to contact a portion of the at least one side panel to at least partially maintain the closed configuration of the carton; and forming the open configuration of the carton in which the lid is in the open position such that the at least one top end flap is raised away from the portion of the at least one side panel.

22. The method of claim 21, wherein a top opening defined by the recessed top portion is larger than the bottom panel.

23. The method of claim 22, wherein the at least one side panel is a first side panel, the at least one top end flap is a first top end flap in contact with a portion of the first side panel, the plurality of panels further comprises a second side panel foldably connected to the bottom panel, and the plurality of end flaps further comprises a second top end flap foldably connected to the top panel, and the forming the closed configuration of the carton comprises upwardly folding the second top end flap to contact a portion of the second side panel.

24. The method of claim 23, wherein the plurality of panels further comprises a hinge panel foldably connected to each of the top panel and the back panel.

25. The method of claim 24, wherein the folding the plurality of panels comprises positioning the hinge panel in at least partial face-to-face contact with the back panel.

26. The method of claim 22, wherein the top panel comprises a window for viewing the interior of the carton.

27. The method of claim 26, wherein the window comprises an opening in the top panel and a film overlying the opening.

28. The method of claim 27, wherein the film is formed of a polymeric material and is at least partially transparent.

29. The method of claim 22, wherein at least one locking opening at least partially extends into the front panel, the at least one top end flap comprises a locking tab, and the forming the closed configuration of the carton further comprises at least partially inserting the locking tab through the at least one locking opening.

30. The method of claim 29, wherein the plurality of end flaps comprises at least one front end flap foldably connected to the front panel at a fold line, the at least one locking opening interrupts the fold line.

31. The method of claim 29, wherein a recess is formed in a portion of the front panel, the top panel comprises a handle tab, and the forming the closed configuration of the carton comprises positioning the handle tab extending at least partially through the recess.

32. A system of cartons for holding at least one article, the system comprising:

a first carton, the first carton comprising:

a plurality of panels extending at least partially around an interior of the first carton, the plurality of panels comprising a top panel, a bottom panel, a front panel foldably connected to the bottom panel, a back panel foldably connected to the bottom panel, and at least one side panel foldably connected to the bottom panel; and a plurality of end flaps foldably connected to a respective panel of the plurality of panels, the plurality of end flaps comprising at least one top end flap foldably connected to the top panel, the bottom panel, the front panel, the back panel, and the at least one side panel at least partially forming a tray of the first carton, and the top panel at least partially forming a lid of the first carton, the lid hingeably connected to the tray such that the lid is positionable between a closed position to form a closed configuration of the first carton and an open position in which the lid is raised above the tray to provide access to the interior of the first carton, the at least one top end flap being upwardly folded and contacting a portion of the at least one side panel to at least partially maintain the closed configuration of the first carton in which the top panel is recessed below a portion of each of the front panel, the back panel, and the at least one side panel to form a recessed top portion, the at least one top end flap for being raised away from the portion of the at least one side panel when the lid is in the open position; and a second carton at least partially received in the recessed top portion of the first carton.

33. The system of claim 32, wherein a top opening defined by the recessed top portion is larger than the bottom panel.

34. The system of claim 33, wherein the at least one side panel is a first side panel, the at least one top end flap is a first top end flap in contact with a portion of the first side panel, the plurality of panels further comprises a second side panel foldably connected to the bottom panel, and the plurality of end flaps further comprises a second top end flap foldably connected to the top panel and upwardly folded to contact a portion of the second side panel.

35. The system of claim 34, wherein the plurality of panels further comprises a hinge panel foldably connected to each of the top panel and the back panel.

36. The system of claim 35, wherein the hinge panel is in at least partial face-to-face contact with the back panel.

37. The system of claim 33, wherein the top panel comprises a window for viewing the interior of the first carton.

38. The system of claim 37, wherein the window comprises an opening in the top panel and a film overlying the opening.

39. The system of claim 38, wherein the film is formed of a polymeric material and is at least partially transparent.

40. The system of claim 33, wherein at least one locking opening at least partially extends into the front panel, and the at least one top end flap comprises a locking tab at least partially received through the at least one locking opening to at least partially maintain the closed configuration of the first carton.

41. The system of claim 40, wherein the plurality of end flaps comprises at least one front end flap foldably connected to the front panel at a fold line and positioned in at least partial face-to-face contact with the at least one side panel, the at least one locking opening interrupts the fold line.

42. The system of claim 40, wherein a recess is formed in a portion of the front panel, and the top panel comprises a handle tab that extends at least partially through the recess to at least partially maintain the closed configuration of the first carton.

* * * * *